US008316525B2

(12) United States Patent
Nicoson

(10) Patent No.: US 8,316,525 B2
(45) Date of Patent: Nov. 27, 2012

(54) METHOD OF ATTACHING TWO LARGE STRUCTURAL MEMBERS

(75) Inventor: Richard L. Nicoson, Hartford, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 585 days.

(21) Appl. No.: 12/542,181

(22) Filed: Aug. 17, 2009

(65) Prior Publication Data

US 2011/0038663 A1 Feb. 17, 2011

(51) Int. Cl.
*B23P 11/00* (2006.01)
*F16B 1/00* (2006.01)

(52) U.S. Cl. ..... 29/525.01; 403/24

(58) Field of Classification Search ..... 29/525.01, 29/525.02, 428, 434, 469, 281.5, 896.93, 29/897; 403/24
See application file for complete search history.

(56) References Cited

U.S. PATENT DOCUMENTS 3,648,782 A * 3/1972 Mazzarins ..... 172/821

* cited by examiner

*Primary Examiner* — John C Hong
(74) *Attorney, Agent, or Firm* — Michael Best & Friedrich LLP

(57) ABSTRACT

A method of attaching a first structural member to a second structural member, the method comprising the steps of: attaching a plurality of spaced apart female pieces to the first structural member, pivotally attaching a plurality of spaced apart male pieces to the second structural member, the positions of the male pieces corresponding to the positions of the female pieces, inserting the male pieces into the female pieces, and connecting the male pieces and respective female pieces together.

20 Claims, 6 Drawing Sheets

METHOD OF ATTACHING TWO LARGE STRUCTURAL MEMBERS

BACKGROUND

This disclosure relates to a method of attaching two large structural members together, and more particularly, to a method of attaching a ladder to the boom of an electric shovel.

Currently, as shown in FIGS. 1 and 2, the large structural members are positioned adjacent each other, and an L-shaped piece of metal 2 is positioned at the contact point between the two structural members 4 and 6. Welding of the piece of metal to the structural members then serves to attach the two structural members. As one can imagine, with each welding of each piece of metal, the careful positioning of the two structural members adjacent each other can be altered. As a result, the careful positioning of the structural members is often compromised.

SUMMARY

The object of this invention is to facilitate the attachment of large structural members.

This disclosure provides a method of attaching a first structural member to a second structural member, the method comprising the steps of: attaching a plurality of spaced apart female pieces to the first structural member, pivotally attaching a plurality of spaced apart male pieces to the second structural member, the positions of the male pieces corresponding to the positions of the female pieces, inserting the male pieces into the female pieces, and connecting the male pieces and respective female pieces together.

In the preferred embodiment, the method includes providing space between the connecting rod and the male piece to permit some vibration freedom between the structural members, and providing a rubber bushing between the connecting rod and the male piece to permit some vibration freedom between the structural members.

BRIEF DESCRIPTION OF THE DRAWINGS

FIG. 1 illustrates a ladder attached to a boom of an electric shovel.

Figure 1:
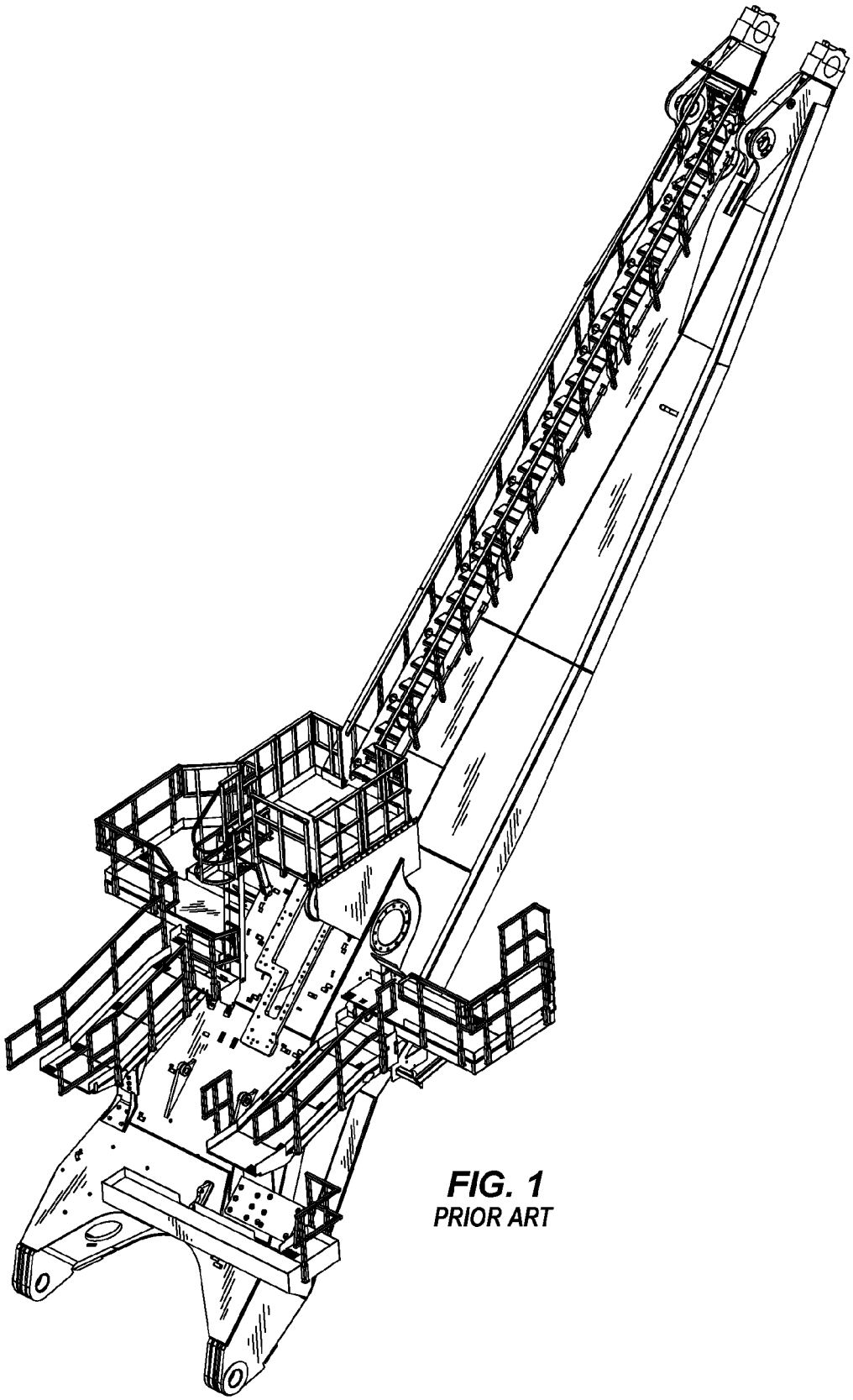
FIG. 1 PRIOR ART
FIG. 1 is a perspective view of two large structural members attached one to another. More particularly.
Figure 2:
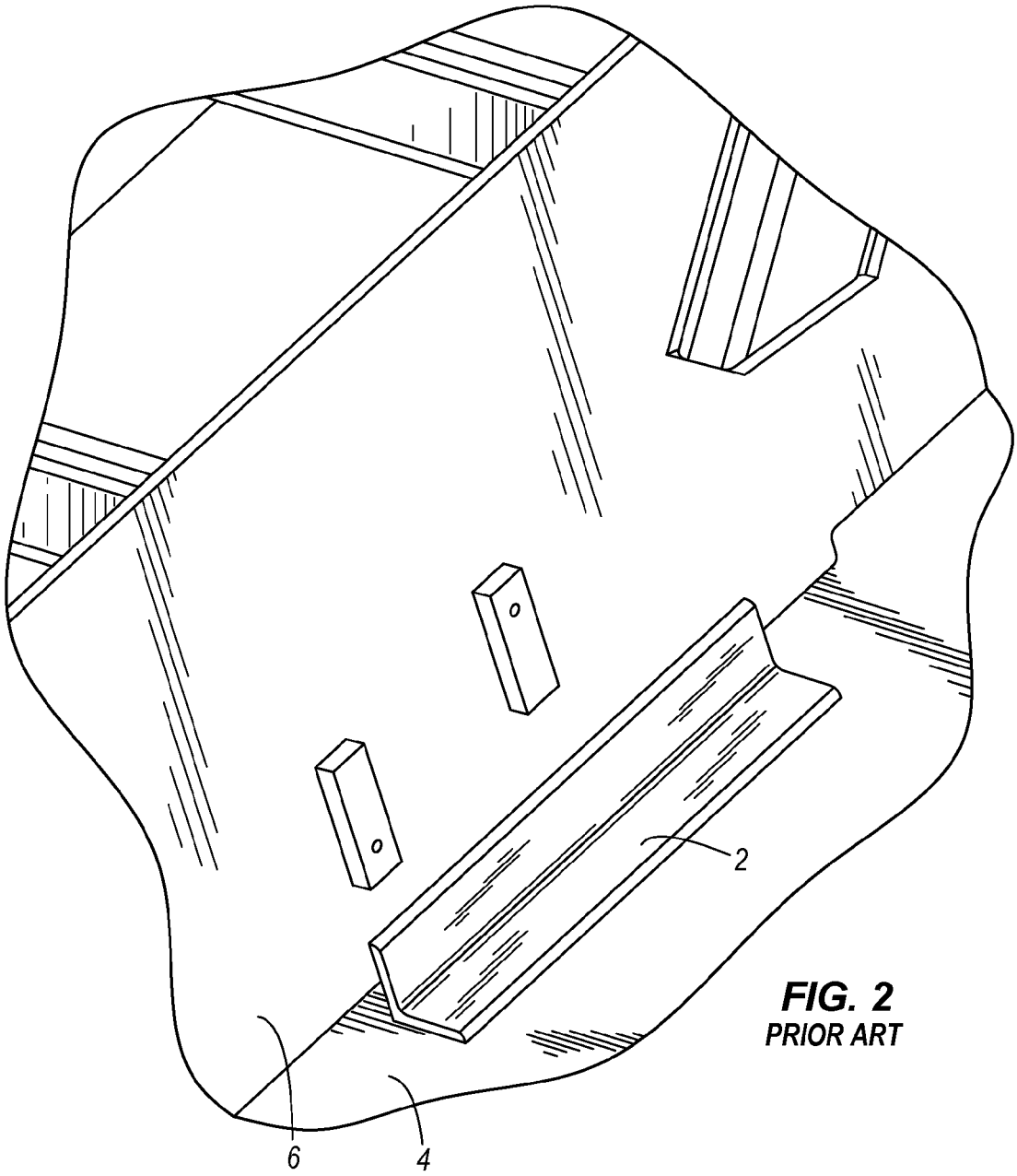
FIG. 2 PRIOR ART
FIG. 2 is a perspective view of the place of attachment of the ladder to the boom, illustrating an L-shaped metal piece.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

Figure 3:
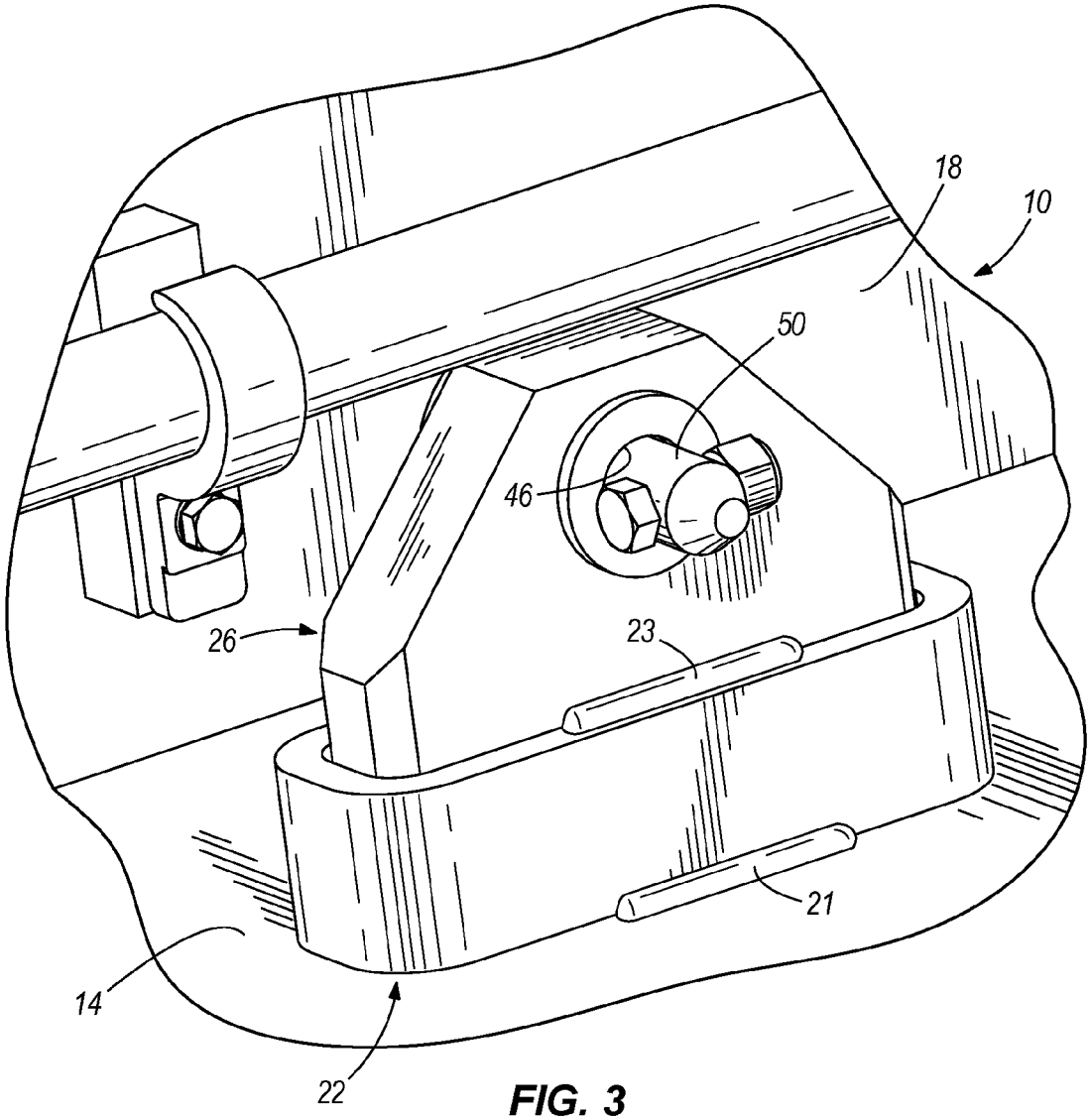
FIG. 3 is a perspective view of the attachment of the latter to the boom using the joint of this disclosure.
Figure 4:
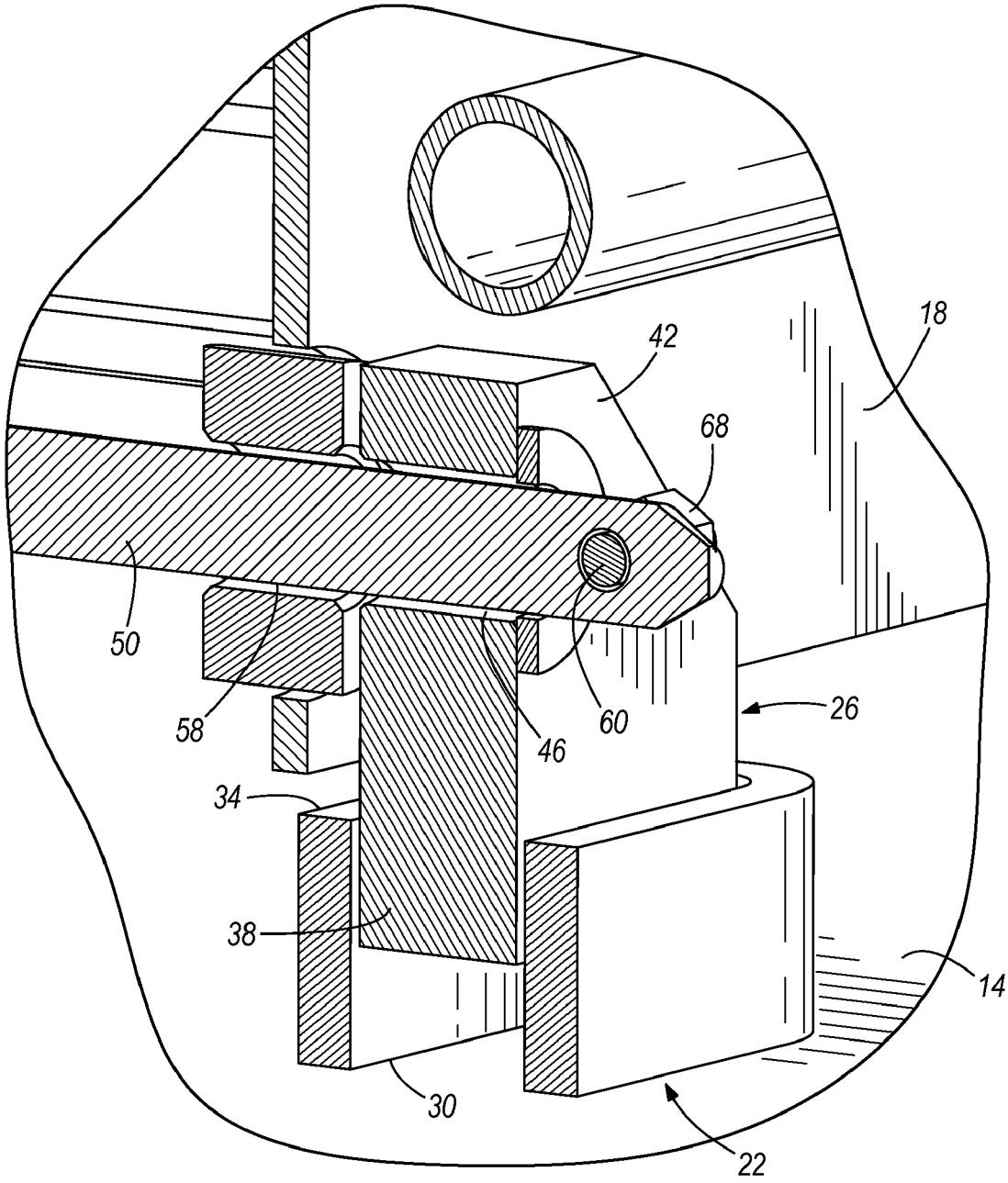
FIG. 4 is a perspective view of a cross-section of the joint shown in FIG. 3.
Figure 5:
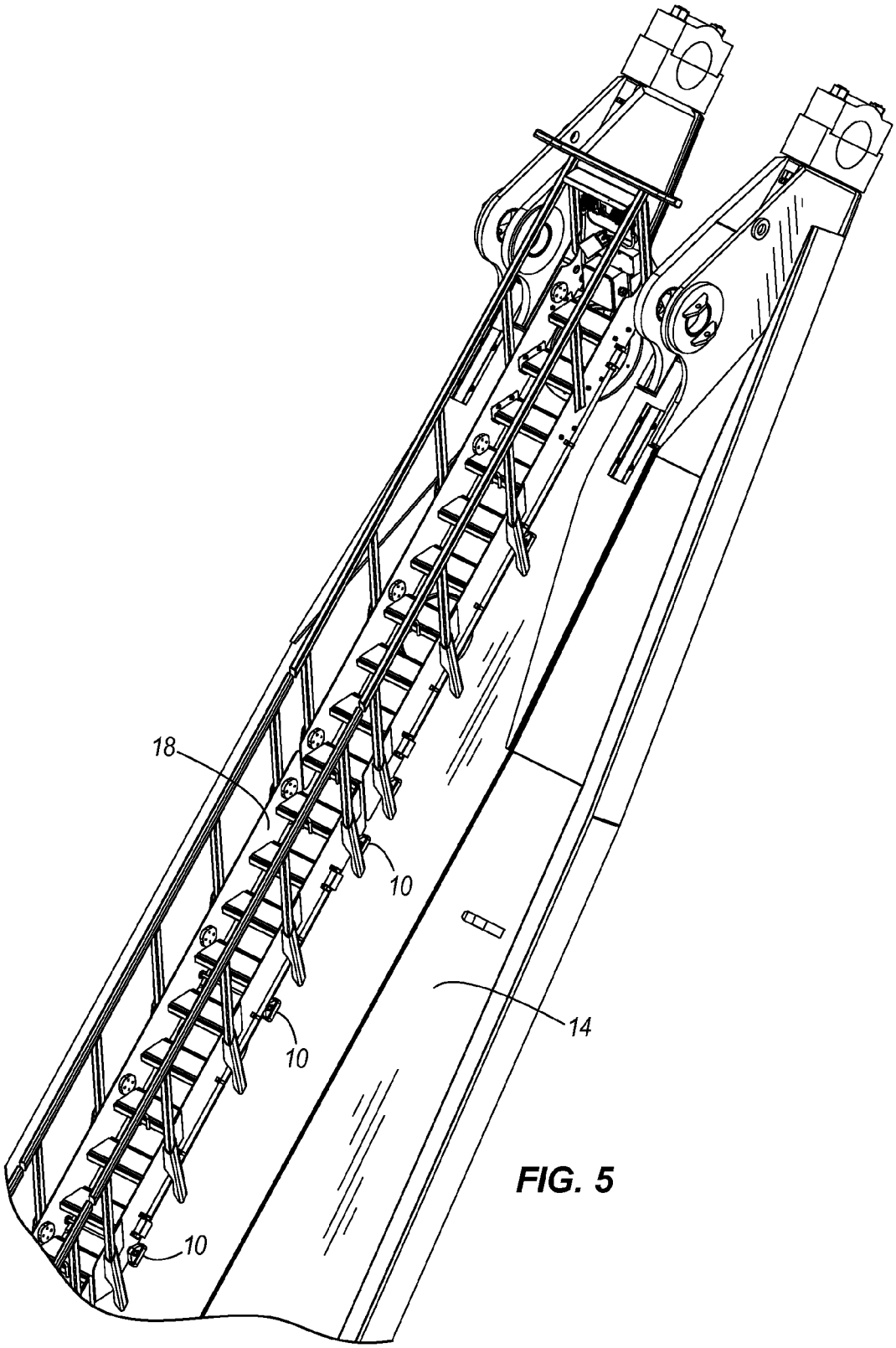
FIG. 5 is a perspective view of a ladder attached to a boom of an electric shovel using the joint of this disclosure.

As illustrated in FIGS. 3 through 5, this disclosure provides a method of attaching a first large structural member to a second large structural member, where the first large structural member is a boom 14 of an electric shovel (not shown), and wherein the second large structural member is a ladder 18 for servicing the boom 14. The method comprises the steps of forming a point of attachment 10 between the boom 14 and ladder 18 by attaching, such as by welding 21, a plurality of spaced apart female pieces 22 to the first structural member 14, pivotally attaching a plurality of spaced apart male pieces 26 to the second structural member 18, the positions of the male pieces 26 corresponding to the positions of the female pieces 22, inserting the male pieces 26 into the female pieces 22, and connecting, such as by welding 23, the male pieces 26 and respective female pieces 22 together.

More particularly, the female piece 22 is a metal oblong cylinder, having an open bottom 30 and an open top 34. The male piece 26 is a metal plate sized in order to fit securely within the female piece 22. The male piece 26 has rounded corners to facilitate its insertion into the female piece 22.

The male piece 26 is a plate having a first square end 38, and a second opposite tapered end 42. The tapered end 42 has an opening 46 adapted to receive a connecting rod 50. The connecting rod 50 extends through the ladder 18 and through the opening 46 in the male piece 26. In the preferred embodiment, not shown, the connecting rod passes through spaced apart openings 58 in the ladder 18, and a male piece 26 is received on the end of the connecting rod 50 on the outside of each of the opposite sides of the ladder 18.

Figure 6:
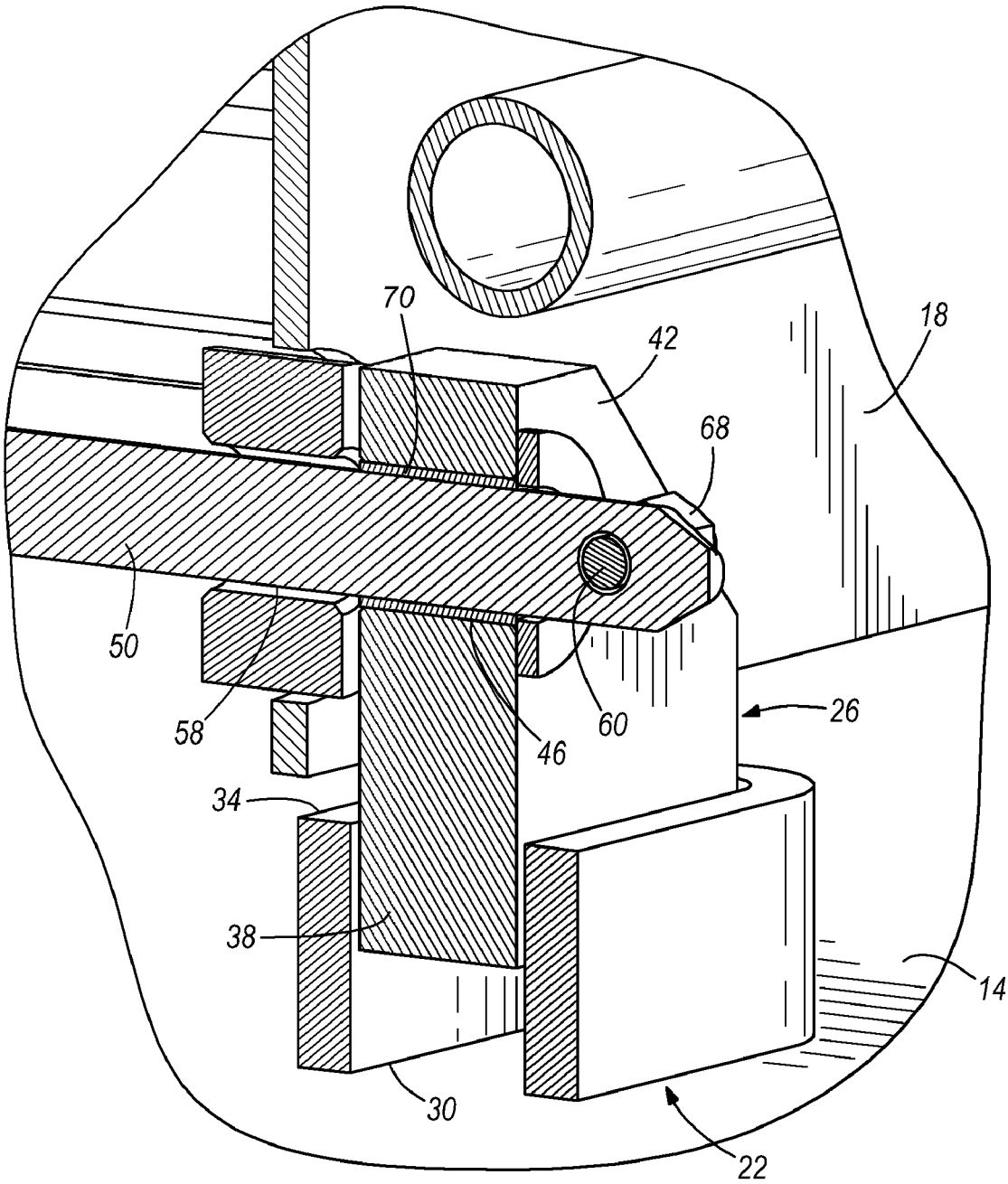
FIG. 6 is a perspective view of a cross section of a joint similar to that shown in FIG. 3 and including a bushing.

After the connecting rod 50 passes through the opening 46 in the male piece 26, a bolt 60 passes through an opening 64 in the end of the connecting rod 50, and a nut 68 is placed on the end of the bolt 60. In the preferred embodiment, the rod 50 is loosely received within the opening 46 in the male piece 26 to help prevent transmission of ladder vibrations to the boom 14. A steel or rubber bushing 70 (see FIG. 6) can also be provided between the connecting rod 50 and the male piece 26 to permit some vibration freedom between the structural members.

Various other features and advantages of the disclosure are apparent from the following claims.

The invention claimed is:

1. A method of attaching a ladder to a boom of a shovel, the boom having a length extending along an axis, the method comprising:

attaching a plurality of female pieces to the boom, the female pieces being spaced apart along the length of the boom, each female piece defining an opening;

pivotally attaching a plurality of spaced apart male pieces to the ladder, the positions of the male pieces corresponding to the positions of the female pieces;

positioning the ladder on the boom generally parallel to the axis;

inserting each male pieces into an opening of an associated female piece; and connecting each male piece to the associated female piece.

2. The method in accordance with claim 1, wherein pivotally attaching a plurality of male pieces to the ladder includes connecting a connecting rod between each male piece and the ladder.

3. The method in accordance with claim 2, and further comprising providing space between the connecting rod and an associated male piece to permit vibrational freedom between the ladder and the boom.

4. The method in accordance with claim 3, and further comprising providing a bushing in the space between the connecting rod and an associated male piece to permit vibrational freedom between the ladder and the boom.

5. The method in accordance with claim 2, wherein the ladder defines a ladder opening, wherein each male piece defines a male piece opening, and wherein connecting a connecting rod includes passing the connecting rod through the ladder opening and through the male piece opening.

6. The method in accordance with claim 2, and further comprising passing a bolt through a bolt opening in the connecting rod to maintain the connecting rod coupled to the male piece.

7. The method in accordance with claim 6, and further comprising threading a nut onto the bolt.

8. The method in accordance with claim 1, wherein the ladder has opposite sides, and wherein pivotally attaching a plurality of spaced apart male pieces to the ladder includes pivotally attaching male pieces on each side of the ladder.

9. The method in accordance with claim 8, wherein pivotally attaching a plurality of male pieces to the ladder includes connecting a connecting rod between the ladder and a male piece on each side of the ladder.

10. The method in accordance with claim 9, wherein the ladder defines ladder openings in each side, wherein each male piece defines a male piece opening, and wherein connecting a connecting rod includes passing the connecting rod through the ladder openings and through the male piece opening in the male piece on each side of the ladder.

11. A method of attaching a ladder to a boom of a shovel, the boom having a length extending along an axis, the method comprising:

attaching a female piece to one of the boom and the ladder, the female piece defining an opening;

attaching a male piece to the other of the boom and the ladder, one of the female piece and the male piece being pivotally attached to the associated one of the boom and the ladder;

positioning the ladder on the boom generally parallel to the axis;

inserting the male piece into the opening of the piece; and connecting the male piece to the female piece.

12. The method in accordance with claim 11, wherein attaching a female piece includes attaching a female piece to the boom, and wherein attaching a male piece includes attaching a male piece to the ladder.

13. The method in accordance with claim 12, wherein attaching a male piece to the ladder includes pivotally attaching a male piece to the ladder.

14. The method in accordance with claim 13, wherein pivotally attaching a male piece to the ladder includes connecting a connecting rod between the male piece and the ladder.

15. The method in accordance with claim 14, wherein the ladder defines a ladder opening, wherein the male piece defines a male piece opening, and wherein connecting a connecting rod includes passing the connecting rod through the ladder opening and through the male piece opening.

16. The method in accordance with claim 14, and further comprising providing space between the connecting rod and the male piece to permit vibrational freedom between the ladder and the boom.

17. The method in accordance with claim 16, and further comprising providing a bushing in the space between the connecting rod and the male piece to permit vibrational freedom between the ladder and the boom.

18. The method in accordance with claim 13, wherein the ladder has opposite sides, and wherein pivotally attaching a male piece to the ladder includes pivotally attaching a male piece on each side of the ladder.

19. The method in accordance with claim 18, wherein pivotally attaching a male piece to the ladder includes connecting a connecting rod between the ladder and a male piece on each side of the ladder.

20. The method in accordance with claim 19, wherein the ladder defines ladder openings in each side, wherein each male piece defines a male piece opening, and wherein connecting a connecting rod includes passing the connecting rod through the ladder openings and through the male piece opening in the male piece on each side of the ladder.

* * * * *